US011545128B2

(12) United States Patent
Su et al.

(10) Patent No.: US 11,545,128 B2
(45) Date of Patent: Jan. 3, 2023

(54) ACOUSTIC STRUCTURE FOR SOUND ABSORPTION AND IMPROVED SOUND TRANSMISSION LOSS

(71) Applicant: Toyota Motor Engineering & Manufacturing North America, Inc., Plano, TX (US)

(72) Inventors: Xiaoshi Su, Ann Arbor, MI (US); Debasish Banerjee, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 522 days.

(21) Appl. No.: 16/679,839

(22) Filed: Nov. 11, 2019

(65) Prior Publication Data

US 2021/0142777 A1 May 13, 2021

(51) Int. Cl.

| | |
|---|---|
| ***G10K 11/20*** | (2006.01) |
| ***G10K 11/172*** | (2006.01) |
| ***G10K 11/162*** | (2006.01) |

(52) U.S. Cl.

CPC ..... *G10K 11/20* (2013.01); *G10K 11/162* (2013.01); *G10K 11/172* (2013.01)

(58) Field of Classification Search

CPC ..... G10K 11/172; G10K 11/162; G10K 11/20
USPC ..... 181/224, 286
See application file for complete search history.

(56) References Cited

U.S. PATENT DOCUMENTS

| | | | | |
|---|---|---|---|---|
| 7,178,630 | B1 * | 2/2007 | Perdue | E04B 1/8209 181/290 |
| 9,607,600 | B2 * | 3/2017 | Swallowe | G10K 11/172 |
| 10,255,900 | B2 * | 4/2019 | DeGrandis | G10K 11/20 |
| 10,688,930 | B2 * | 6/2020 | Ji | B60R 1/00 |
| 10,714,070 | B1 * | 7/2020 | Su | G10K 11/175 |
| 11,114,080 | B2 * | 9/2021 | Lee | G10K 11/162 |
| 11,199,165 | B2 * | 12/2021 | Kimura | F02M 35/10321 |
| 2017/0263235 | A1 * | 9/2017 | Elford | G10K 11/172 |
| 2018/0114517 | A1 * | 4/2018 | Yamazoe | E04B 1/84 |
| 2018/0122352 | A1 * | 5/2018 | Hakuta | E04B 1/84 |
| 2019/0206380 | A1 * | 7/2019 | Hakuta | F24F 13/24 |
| 2020/0224810 | A1 * | 7/2020 | Hakuta | G10K 11/172 |

OTHER PUBLICATIONS

Long et al., "Multiband quasi-perfect low-frequency sound absorber based on double-channel Mie resonator," Applied Physics Letters 112, 7 pages, 033507 (2018).

(Continued)

*Primary Examiner* — Forrest M Phillips
(74) *Attorney, Agent, or Firm* — Christopher G. Darrow; Darrow Mustafa PC

(57) ABSTRACT

An acoustic structure includes a plate and at least one acoustic scatterer having a resonant frequency and coupled to a side of the plate. The at least one acoustic scatterer has an opening, a first channel and a second channel. The first channel has a first channel open end and a first channel terminal end with the first channel open end being in fluid communication with the opening. The second channel has a second channel open end and a second channel terminal end with the second channel open end being in fluid communication with the opening. The first channel terminal end and the second channel terminal end are separate from one another.

20 Claims, 6 Drawing Sheets

(56) References Cited

OTHER PUBLICATIONS

Lee et al., "Ultrasparse Acoustic Absorbers Enabling Fluid Flow and Visible-Light Controls," Physical Review Applied 11, 14 pages, 024022 (2019).
Elliott et al., "Omnidirectional acoustic absorber with a porous core and a metamaterial matching layer," Journal of Applied Physics 115, 204902, 15 pages (2014).
Liang & Li, "Extreme Acoustic Metamaterial by Coiling Up Space," Phys. Rev. Lett. 108, 114301, 5 pages (2012).
Cheng et al., "Ultra-sparse metasurface for high reflection of low-frequency sound based on artificial Mie resonances," Nature Materials, 14, 1013-1019 (2015).
Ghaffarivardavagh et al., "Ultra-open acoustic metamaterial silencer based on Fano-like interference," Phys. Rev. B 99, 024302, 3 pages, Abstract (2019).
Schwan et al., "Sound absorption and reflection from a resonant metasurface: Homogenisation model with experimental validation," Wave Motion, 72, 154-172 (2017).

* cited by examiner

ACOUSTIC STRUCTURE FOR SOUND ABSORPTION AND IMPROVED SOUND TRANSMISSION LOSS

TECHNICAL FIELD

The present disclosure relates to acoustic structures that absorb sound and improve sound transmission loss.

BACKGROUND

The background description provided is to generally present the context of the disclosure. Work of the inventors, to the extent it may be described in this background section, and aspects of the description that may not otherwise qualify as prior art at the time of filing, are neither expressly nor impliedly admitted as prior art against the present technology.

Low-frequency noise issues are a common issue in a variety of different environments. There are several different solutions for managing low-frequency noises, but many have drawbacks. For example, conventional porous sound absorbing materials are only efficient for high frequency noise reduction due to its high impedance nature. The sound transmission through porous materials is high if the material microstructure has a large porosity.

In the automotive industry, the low-frequency noise has been a long-standing issue for passenger comfort. However, the sound isolation performance is limited by the so-called "mass-law". The "mass-law" states that doubling the mass per unit area increases the sound transmission loss ("STL") by six decibels. Similarly, doubling the frequency increases the STL by six decibels. This effect makes it difficult to isolate low frequency sound using lightweight materials. In order to achieve high STL, one may either reflect or absorb the sound energy. However, achieving high absorption and high STL at the same time is also difficult, because high absorption usually requires impedance matching, which leads to high transmission.

SUMMARY

This section generally summarizes the disclosure and is not a comprehensive disclosure of its full scope or all its features.

Examples of sound isolation devices and sound isolation systems are described herein. In one embodiment, an acoustic structure includes a plate and at least one acoustic scatterer having a resonant frequency and coupled to a side of the plate. The at least one acoustic scatterer has an opening, a first channel and a second channel. The first channel has a first channel open end and a first channel terminal end with the first channel open end being in fluid communication with the opening. The second channel has a second channel open end and a second channel terminal end with the second channel open end being in fluid communication with the opening. The first channel terminal end and the second channel terminal end are separate from one another.

In another embodiment, an acoustic scatterer having a resonant frequency includes a housing defining an opening, a first channel, and a second channel. The first channel has a first channel open end and a first channel terminal end with the first channel open end being in fluid communication with the opening. The second channel has a second channel open end and a second channel terminal end with the second channel open end being in fluid communication with the opening. The first channel terminal end and the second channel terminal end are separate from one another.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The present teachings will become more fully understood from the detailed description and the accompanying drawings, wherein.

The figures set forth herein are intended to exemplify the general characteristics of the methods, algorithms, and devices among those of the present technology, for the purpose of the description of certain aspects. These figures may not precisely reflect the characteristics of any given aspect and are not necessarily intended to define or limit specific embodiments within the scope of this technology. Further, certain aspects may incorporate features from a combination of figures.

DETAILED DESCRIPTION

The present teachings provide a sound absorbing structure that may include an array of acoustic scatterers, which may be referred to as half scatterers, coupled to a hard plate. This arrangement may achieve high STL beyond the "mass-law" and total acoustic absorption at the same time.

The sound absorbing structure described in this disclosure may achieve high sound absorption and yet, at the same time, be relatively thin. Moreover, in one example, the sound absorbing structure may have a thickness of only 1/16 of the wavelength and can achieve total acoustic absorption. In addition, the sound absorbing structure can essentially break the "mass-law" near the resonant frequency of the acoustic scatterer. At the resonant frequency, the effective mass density of the sound absorbing structure becomes negative so that the sound speed as well as the wavenumber in the material becomes imaginary. The imaginary wavenumber indicates that the wave is exponentially decaying in the material. Also, the impedance of the material is matched to air at the same frequency so that there is no reflection. As a result, all the energy may be absorbed and hence the STL is higher than the mass-law within a certain frequency band.

Moreover, sound projected to the sound absorbing structure is at least partially reflected by the plate without a phase change. The acoustic scatterer behaves like a monopole source at a certain distance from the plate and its mirror image radiates a monopole moment as well. The two monopoles form a new plane wave having a direct reflection from the plate with 180° phase difference. As such, the wave reflected by the plate is essentially canceled out by the new plane wave, thus absorbing the projected sound.

With regards to the design of the sound absorbing structure, the sound absorbing structure may include a plate that has at least one acoustic scatterer attached to the plate. The acoustic scatterer may have a housing that defines two separate channels that each have an open end and a terminal end. The housing of the acoustic scatterer also has an opening that is in fluid communication with the open ends of the channels. The terminal ends of the channels are separate from one another and are not in fluid communication with each other.

Figure 1:
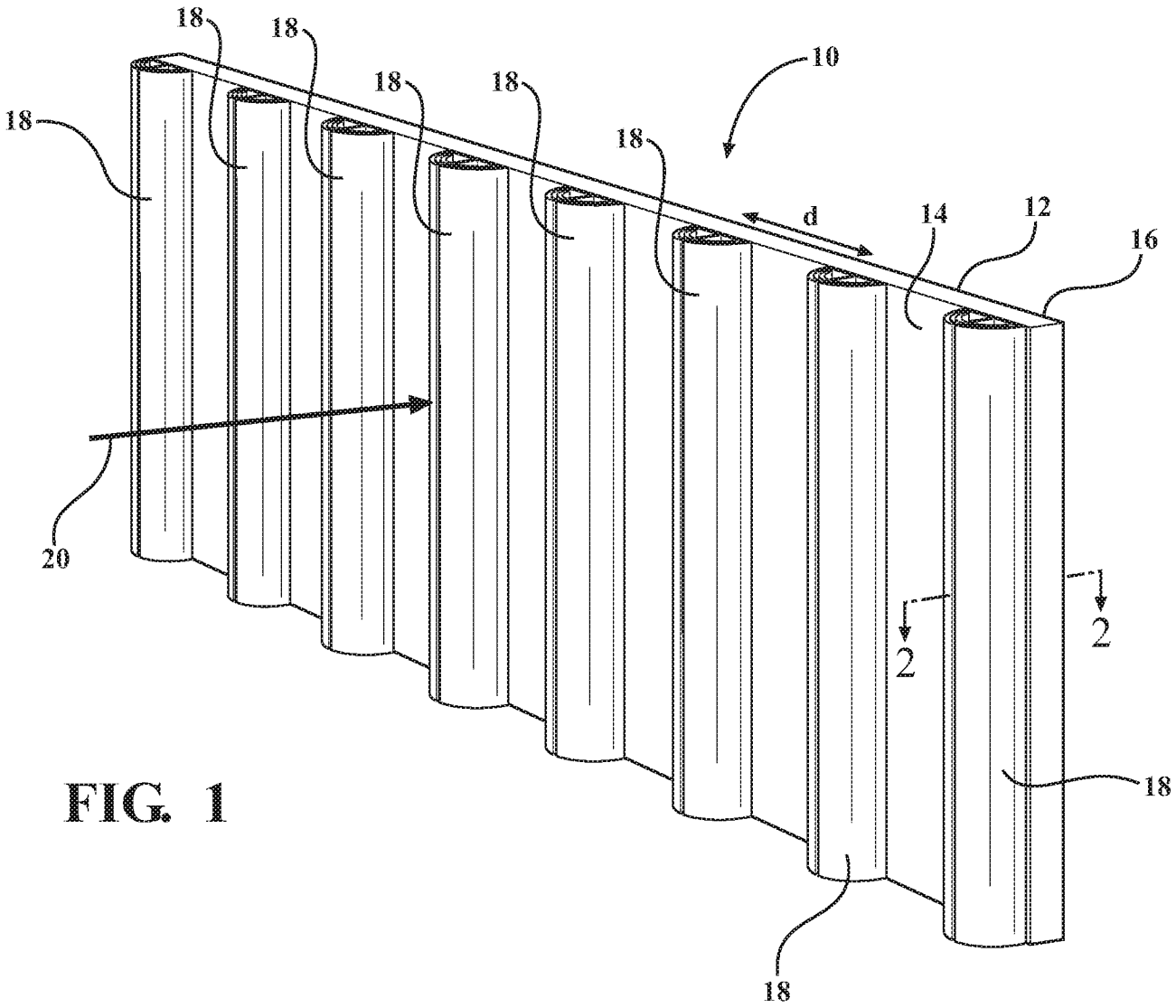
FIG. 1 illustrates a system for absorbing sound and improving sound transmission loss utilizing an array of acoustic scatterers.

Referring to FIG. 1, a sound absorbing structure 10 is shown. The sound absorbing structure includes a plate 12 having a first side 14 and a second side 16. The plate 12 may be made of an acoustically hard material, such as metal, glass, wood, plastic, and the like.

Connected to the first side 14 of the plate 12 are a plurality of acoustic scatterers 18, which may be referred to as half scatterers in this disclosure. The plurality of acoustic scatterers 18 form an array. The acoustic scatterers 18 are separated from each other by a distance of d, which will be explained later in this disclosure. It should be understood that the acoustic scatterers 18 and the plate 12 may be a unitary structure or may utilize one of a number of different methodologies to connect the acoustic scatterers 18 to the plate 12. In one example, the acoustic scatterers 18 may be adhered to the plate 12 using an adhesive, but other types of methodologies to connect the acoustic scatterers 18 to the plate 12 may be utilized, such as mechanical devices like screws, bolts, clips, and the like.

Each of the acoustic scatterers 18 have a resonant frequency. The resonant frequency of each of the acoustic scatterers 18 may be the same resonant frequency or may be different resonant frequencies. Sound absorbed by the sound absorbing structure 10, as will be explained later, substantially matches the resonant frequency of the acoustic scatterers 18. By utilizing acoustic scatterers having different resonant frequencies, a wider range of sounds with different frequencies can be absorbed by the acoustic structure 10.

In this example, a total of eight acoustic scatterers 18 are attached to the plate 12. However, it should be understood that any one of a number of different acoustic scatterers 18 may be utilized. In some examples, only one acoustic scatterer 18 may be utilized, while, in other examples, numerous acoustic scatterers 18 may be utilized.

As stated before, projected sound 20 may originate from any one of a number of different sources or combinations thereof. For example, the source of the projected sound 20, may originate from a speaker, vehicle powertrain, rotating tires of a vehicle, and the like. Again, it should be understood that the sound absorbing structure 10 can be used in any situation where it is desirable to eliminate or reduce sounds of certain frequencies.

As stated before, the projected sound 20 is at least partially reflected by the plate 12 without a phase change. The acoustic scatterers 18 behave like a monopole source at a certain distance from the plate 12 and its mirror image radiates a monopole moment as well. The two monopoles form a new plane wave having a direct reflection from the plate with 180° phase difference. As such, the wave reflected by the plate 12 is essentially canceled out by the new plane wave, thus absorbing the projected sound.

Figure 2A:
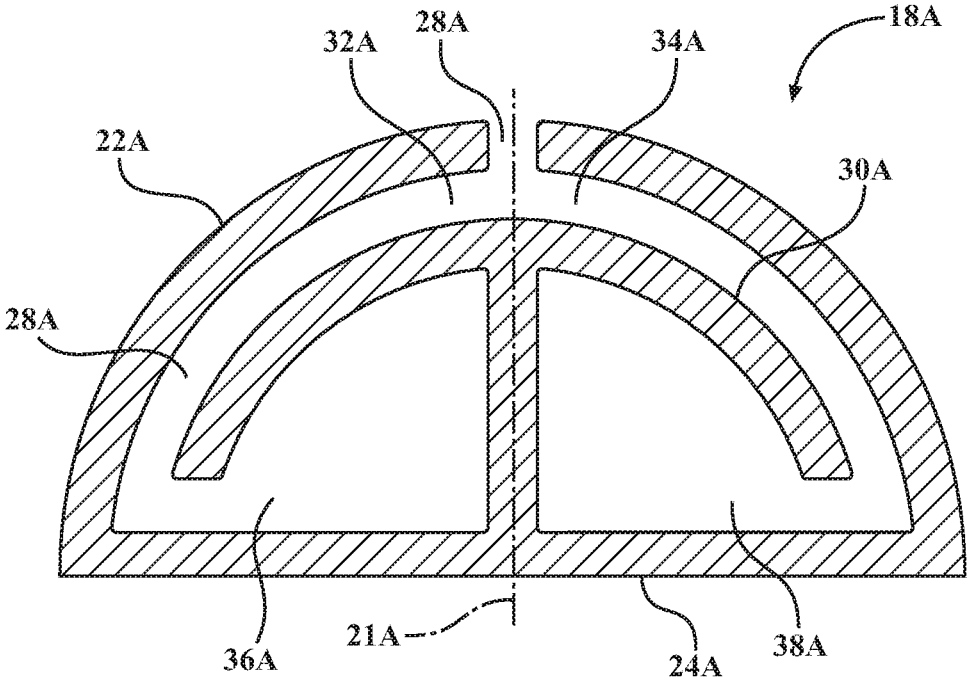
FIG. 2 illustrates a more detailed view of the acoustic scatterer of FIG. 1.

FIG. 2A illustrates a cross-sectional view of one example of an acoustic scatterer 18A generally taken along lines 2-2 of the acoustic scatterer 18 of FIG. 1. This is just but one example of the design of the acoustic scatterer 18A. Here, the acoustic scatterer 18A is generally in the shape of a half cylinder. The half cylinder shape of the acoustic scatterer 18A includes a substantially semicircular portion 22A and a substantially flat portion 24A. The substantially flat portion 24A may be attached to the plate 12 shown in FIG. 1. Additionally, as stated before, the acoustic scatterer 18A and the plate 12 shown in FIG. 1 may be a unitary structure or may be connected to each other using the previous mentioned methodologies. It should be understood that the semicircular portion 22A may take any one of a number of different shapes. These shapes may be non-planar but any suitable shape may be utilized.

The acoustic scatterer 18A may be made of any one of several different materials. Generally, the acoustic scatterer 18A may be made from an acoustically hard material, such as metal, glass, plastic, wood, and the like.

The overall shape of the acoustic scatterer 18A is substantially uniform along the length of the acoustic scatterer 18A. The acoustic scatterer 18A may include a first channel 28A that has an open end 32A and a terminal end 36A. The acoustic scatterer 18A may also include a second channel 30A that has an open and 34A and a terminal end 38A. The open ends 32A and 34A may be in fluid communication with an opening 26A formed on the semicircular portion 22A of the acoustic scatterer 18A. The opening 26A may be adjacent to a line of symmetry 21A of the acoustic scatterer 18A. As to the terminal ends 36A and 38A, these ends are separated from each other and are not in fluid communication with each other. The terminal ends 36A and 38A may terminate in any one of a number of different shapes. Moreover, the terminal ends 36A and 38A may terminate in the form of a chamber or may terminate in the form of a closed off channel.

The channels 28A and 30A may have a circumferential type shape that generally follows the circumference defined by the semicircular portion 22A. The opening 26A may have a width that is substantially similar to the width of the channels 28A and 30A. However, the widths of the channels may vary considerably.

The acoustic scatterer 18A may have a line of symmetry 21A. As such, in this example, the shape of the first channel 28A is essentially a mirror image of the second channel 30A. In addition, the volumes of the channels 28A and 30A may be substantially equal. "Substantially equal" in this disclosure should be understood to indicate approximately 10% difference in the overall volume or shape of the channels 28A and 30A.

Figure 2B:
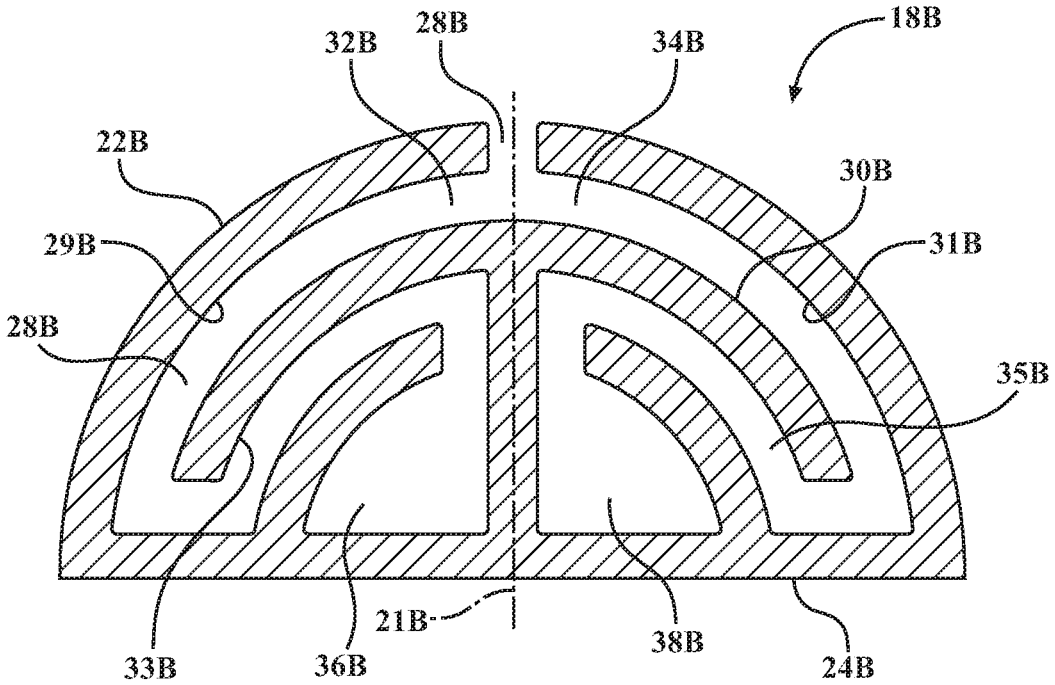

As stated before, the acoustic scatterers 18A of FIG. 1 can take any one of several different shapes. FIG. 2B illustrates another example of an acoustic scatterer 18B. Here, the acoustic scatterer 18B includes a first channel 28B and a second channel 30B. Both the first and second channels 28B and 30B have open ends 32B and 34B, respectively. Also, the first and second channels 28B and 30B have terminal ends 36B and 38B respectively. The open ends 32B and 34B of the channels 28B and 30B may be in fluid communication with the opening 26B generally formed on the outer circumference 22B of the acoustic scatterer 18B. The opening 26B may be adjacent to a line of symmetry 21B of the acoustic scatterer 18A. The terminal ends 36B and 38B may be in the form of a chamber or may be in the form of a closed off channel.

Like before, the flat side 24B may be attached to the first side 14 of the plate 12 by anyone of several different methodologies mention. Additionally, like before, the acoustic scatterer 18B and the plate 12 may be a unitary structure.

In this example, the channel 28B is essentially a zigzag channel. Moreover, the channel 28B includes a first channel 29B in a second channel 33B that generally oppose one another and are parallel to one another. The second channel 30B is similar in that it has a first channel 31B and a second channel 35B the generally oppose each other and run parallel to each other. However, any one of several different designs can be utilized.

The acoustic scatterer 18B may also have a line of symmetry 21B. As such, the first channel 28B may essentially be a mirror image of the second channel 30B Likewise, the volume of the first channel 28B may be substantially equal to the volume of the second channel 30B.

Figure 3A:
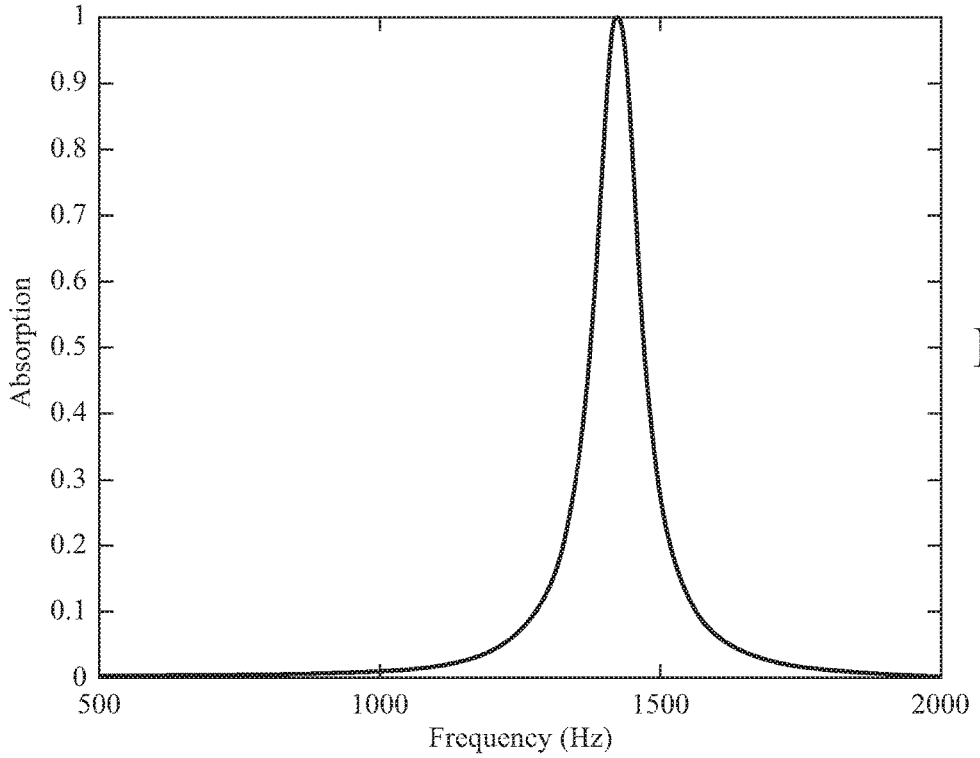
FIGS. 3A and 3B show graphs that illustrate the absorption and sound transmission loss of the acoustic scatterer under normal incidence.
Figure 3B:
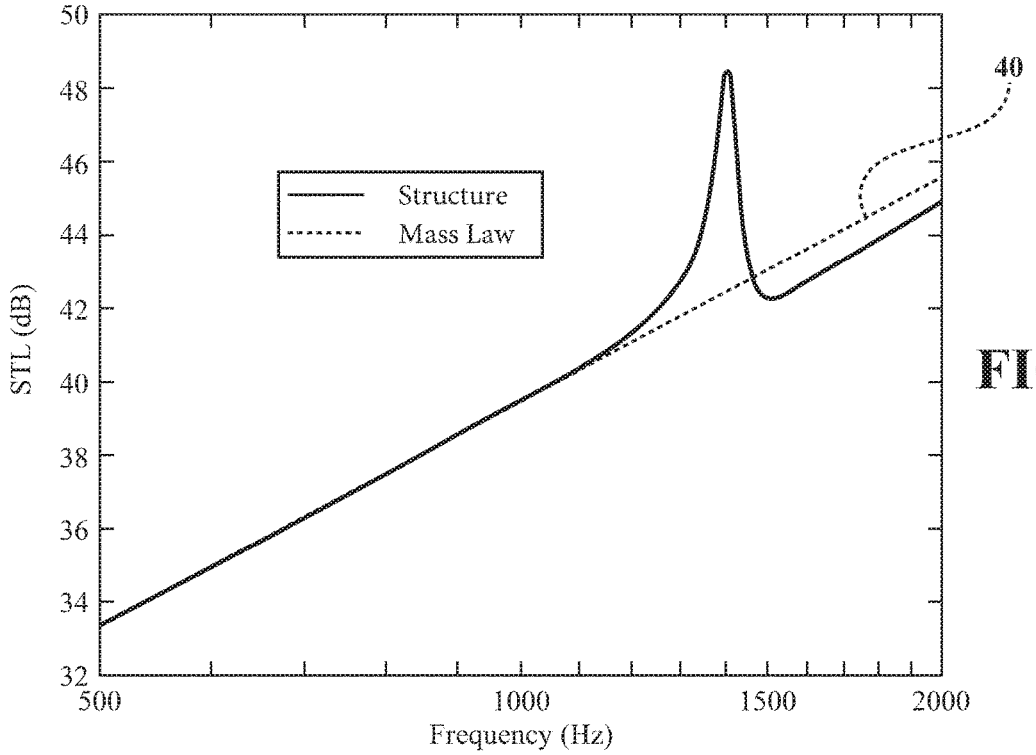

Referring to FIGS. 3A and 3B, illustrated are graphs indicating the absorption coefficient and the STL loss for a sound absorbing structure, similar to the sound absorbing structure 10 of FIG. 1. The acoustic scatterers utilized in this example may be similar to the acoustic scatterer shown and described in FIG. 2A. The sound absorbing structure in this example may have a plate made from silica glass that is 4.76 mm thick with a 0.76 mm thick dampening layer. The acoustic scatterers in this example form an array and may be made from silica glass and fabricated using 3D printing. Additionally, it may be beneficial to make the acoustic scatterer using materials with large stiffness to density ratio as it helps to eliminate the transmission loss dip near the STL peak at the resonant frequency.

The acoustic scatterer in this example has a resonant frequency of 1418 Hz, with a radius of the structure of the acoustic scatterer being 1.4 cm. The optimal center-to-center distance between the acoustic scatterers may be 10.7 cm. The structure has total absorption at 1418 Hz and shows improved STL beyond the mass law near that frequency. As best shown in FIG. 3A, the absorption coefficient indicating the total amount of absorption reaches near or even total absorption at 1418 Hz. With regards to FIG. 3B, the STL is much higher and is essentially able to break the mass-law, which is indicated as dotted line 40.

Figure 4A:
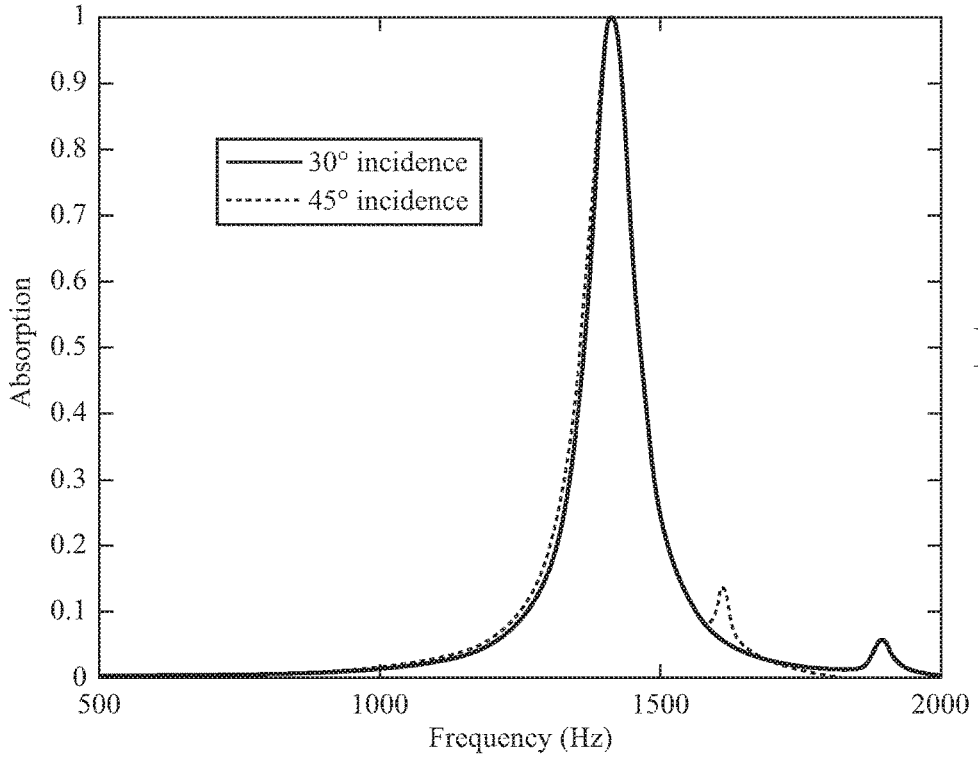
FIGS. 4A and 4B show graphs that illustrate the absorption and sound transmission loss of the acoustic scatterer at different angles of incidence.
Figure 4B:
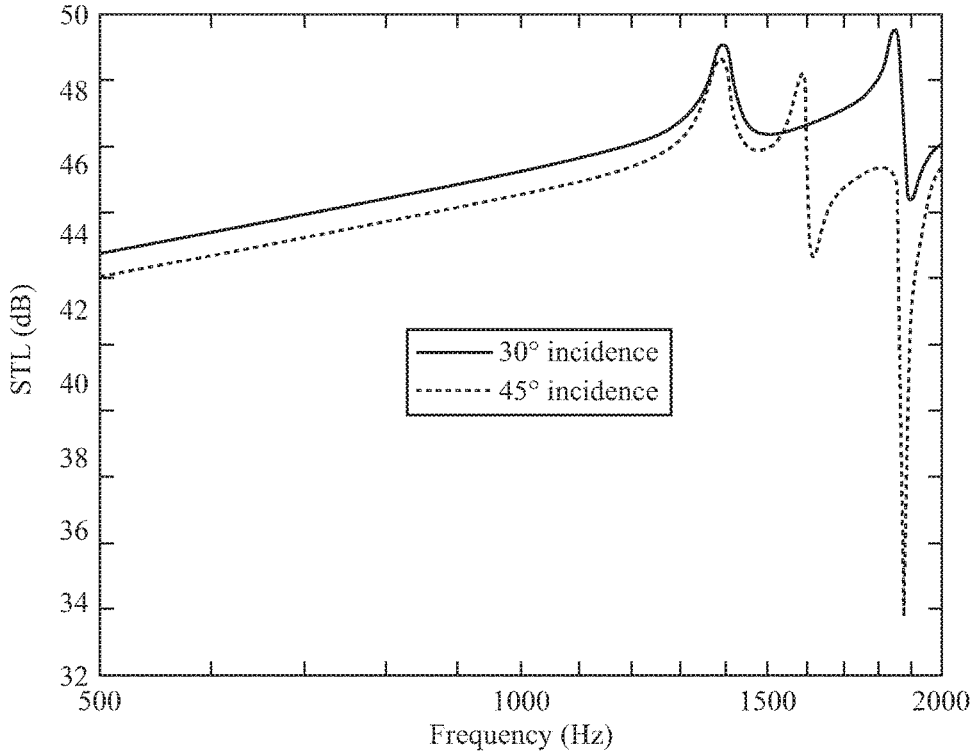

The absorption performance of a material is usually incident angle dependent. The sound absorbing structure and acoustic scatterers disclosed in this disclosure operate over a relatively wide range of incidence. Moreover, as best shown in FIGS. 4A and 4B, the oblique incidence results are shown. Total absorption can still be achieved for 30-degree and 45-degree incidence. The STL performance still show dips near the total absorption frequency. However, high order diffraction modes will start to propagate with the increase of the incident angle. This phenomenon will change the absorption performance. When the high order diffraction modes exist at the scatterer resonant frequency and the incident angle is sufficiently large, then the material cannot achieve total absorption. The disclosed design is tunable so that the spacing between acoustic scatterers can be reduce, and hence increase the working angle.

Figure 5A:
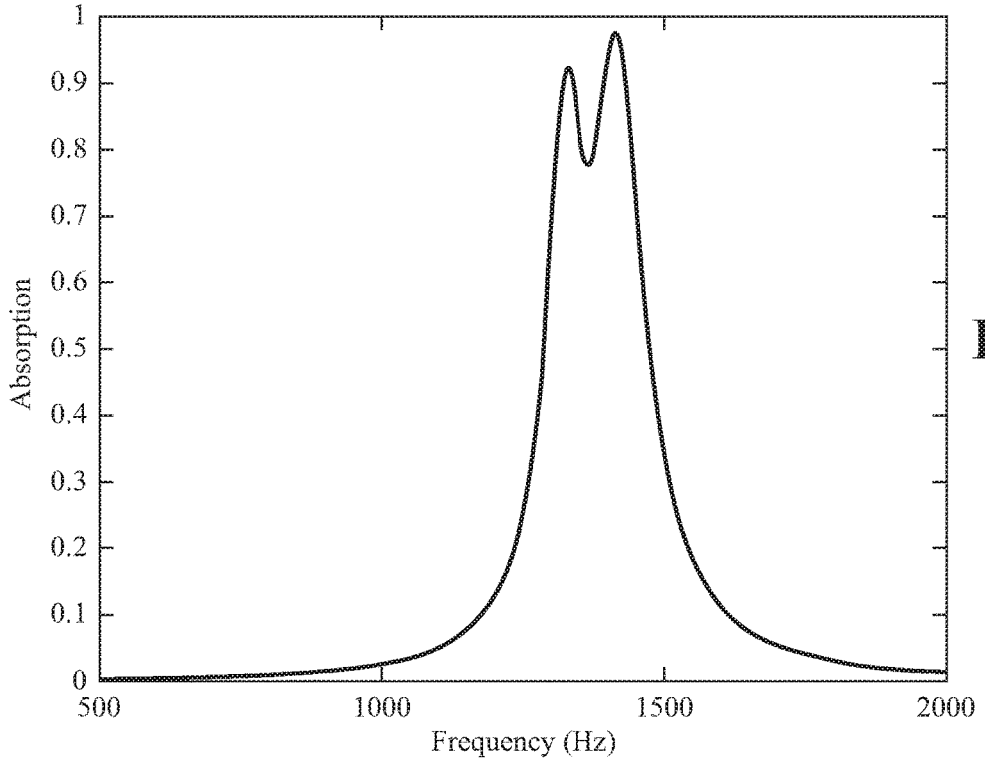
FIGS. 5A and 5B show graphs that illustrate the absorption and sound transmission loss when utilizing acoustic scatterers having different resonant frequencies.
Figure 5B:
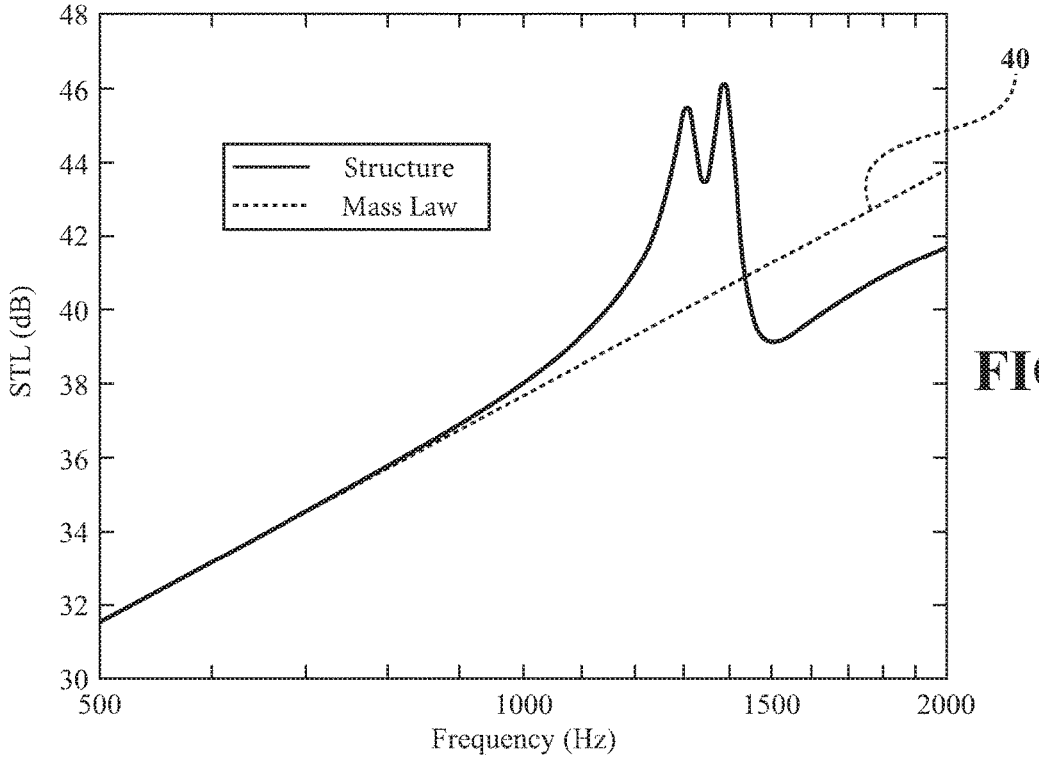
Figure 6A:
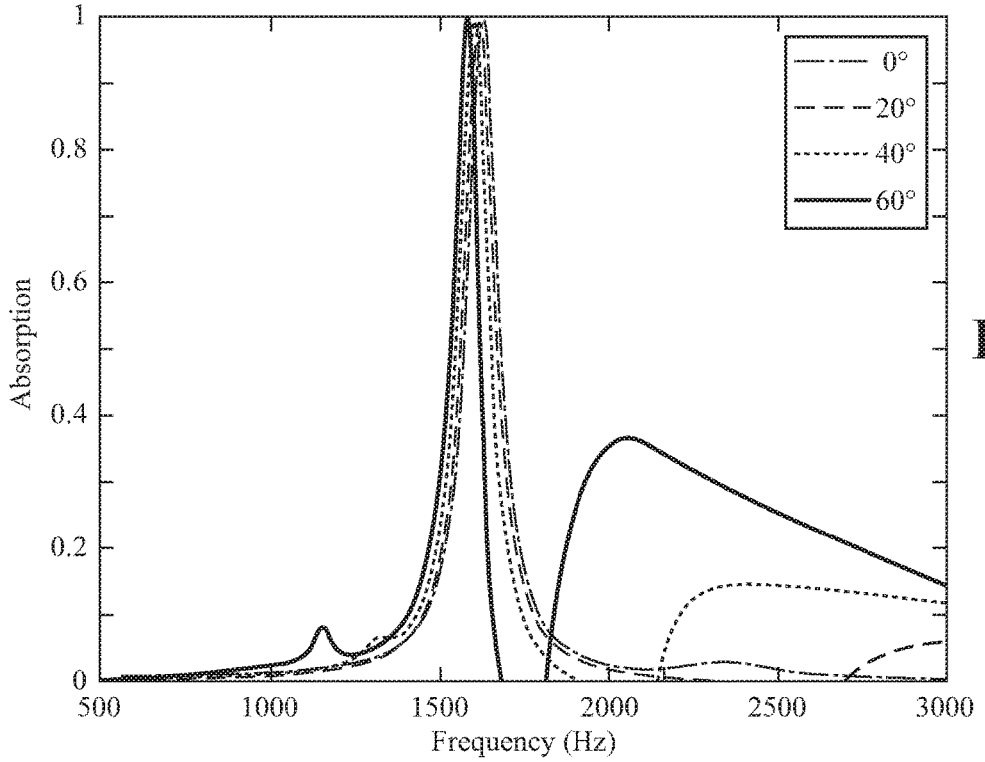
FIGS. 6A and 6B show graphs that illustrate the absorption when utilizing two different types of acoustic scatterers at different angles of incidence.
Figure 6B:
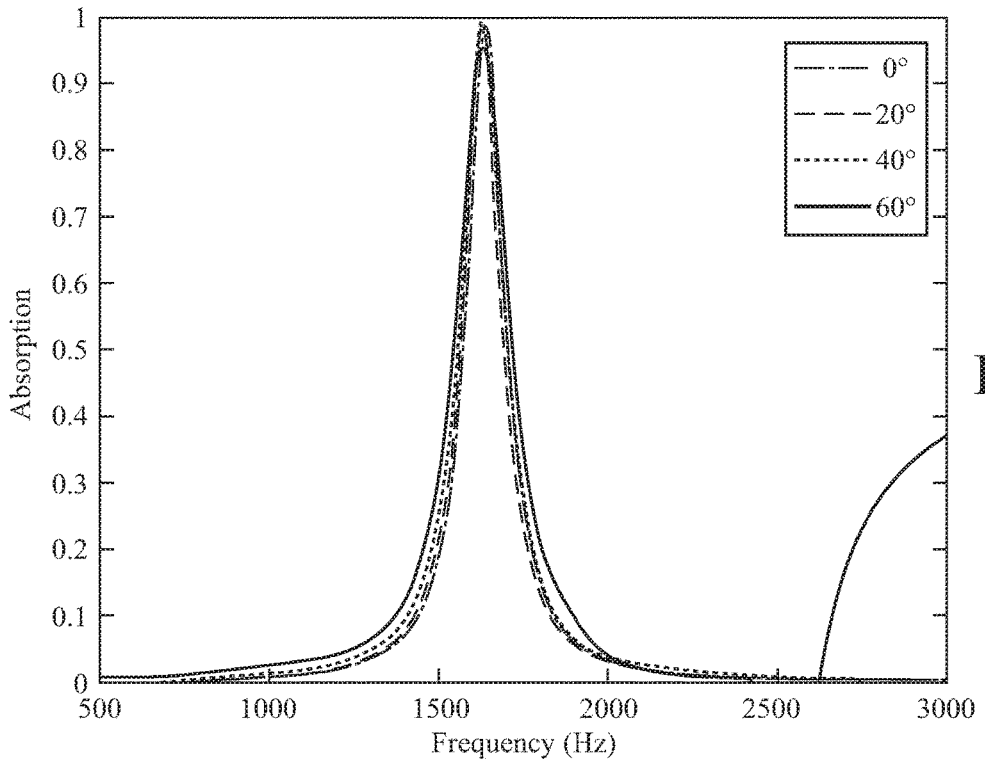

Another benefit of the acoustic scatterer design disclosed in this disclosure is that the acoustic scatterers are separated from each other, so there may be ample space to combine one design with another to cover more frequencies. For example, acoustic scatterers with different resonant frequencies can be utilized to absorb and improve STL across a wider range of frequencies. For example, FIGS. 5A and 5B illustrate the result of sound absorbing structure includes two different types of scatterers, one type of scatterer having a resonant frequency of 1418 Hz and another type of scatterer having a resonant frequency of 1332 Hz. The scatterers both utilize a similar optimal distance. The acoustic scatterer having a resonant frequency of 1332 Hz has a radius of 1.45 cm. The resonant frequency is tuned by adjusting the size of the acoustic scatterer and the channel and/or cavity, as well as the width and length of the air channel. These two acoustic scatterer designs are then combined to achieve broadband performance. As shown in FIGS. 6A and 6B, though the highest absorption at two resonant frequencies are both less than unity, the high absorption bandwidth is much wider than a single scatterer.

The space between the acoustic scatterers that form the array can also be tuned. The benefit of tunable spacing is that one can choose between sparsity and working angle of the material. By reducing the space, the performance of the device will be less sensitive to incident angle of the wave. For example, FIGS. 6A and 6B compares the two designs of the acoustic scatterers in FIGS. 2A and 2B, respectively. The acoustic resonators in both examples have similar resonant frequencies but different spacing. The design of FIG. 6A has a spacing of 10.7 cm, while the design of FIG. 6B has a spacing of 7.5 cm. The design with more internal structures (the design illustrated in FIG. 2B) has bigger radiation impedance, and hence have a smaller optimal spacing for total absorption. It obvious that at 60-degree incidence, the 7.5 cm design works up 2.5 kHz while the 10.7 cm design shows a physically impossible absorption 1.75 kHz (<0).

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An acoustic structure comprising:

a plate;

at least one acoustic scatterer coupled to a side of the plate, the at least one acoustic scatterer having a resonant frequency;

the at least one acoustic scatterer having an opening, a first channel and a second channel;

wherein the first channel has a first channel open end and a first channel terminal end that forms a first chamber, the first channel open end being in fluid communication with the opening;

wherein the second channel has a second channel open end and a second channel terminal end that forms a second chamber, the second channel open end being in fluid communication with the opening; and wherein the first channel terminal end and the second channel terminal end are separate from one another.

2. The acoustic structure of claim 1, wherein the at least one acoustic scatterer has a flat side, the flat side being coupled to the plate.

3. The acoustic structure of claim 2, wherein the at least one acoustic scatterer has a non-planar side, the non-planar side having the opening.

4. The acoustic structure of claim 3, wherein the at least one acoustic scatterer has a half cylinder shape, the half cylinder shape defining the non-planar side and the flat side.

5. The acoustic structure of claim 1, wherein at least one of the first channel and the second channel are shaped in a zigzag design.

6. The acoustic structure of claim 1, wherein a thickness of the acoustic structure has a thickness of approximately 1/16 of a wavelength of a sound wave absorbed by the acoustic structure.

7. The acoustic structure of claim 1, wherein the at least one acoustic scatterer comprises a plurality of acoustic scatters.

8. The acoustic structure of claim 7, plurality of acoustic scatters includes a first scatterer having a first resonant frequency and a second scatterer having a second resonant frequency.

9. The acoustic structure of claim 1, wherein the acoustic structure is configured to absorb sound waves at certain frequency, wherein the certain frequency is substantially similar to the resonant frequency of the at least one acoustic scatterer.

10. The acoustic structure of claim 9, wherein the acoustic structure is configured to absorb sound waves projected towards to acoustic structure at an incidence angle substantially between 0 degrees and 45 degrees.

11. The acoustic structure of claim 10, wherein:

the at least one acoustic scatterer includes a plurality of acoustic scatterers separate from each other by a distance; and wherein the incidence angle of the sound waves absorbed by the acoustic structure varies based on a distance between a plurality of acoustic scatterers.

12. An acoustic structure comprising:

a plate;

at least one acoustic scatterer coupled to a side of the plate, the at least one acoustic scatterer having a resonant frequency;

the at least one acoustic scatterer having an opening, a first channel and a second channel;

wherein the first channel has a first channel open end and a first channel terminal end, the first channel open end being in fluid communication with the opening;

wherein the second channel has a second channel open end and a second channel terminal end, the second channel open end being in fluid communication with the opening;

wherein the first channel terminal end and the second channel terminal end are separate from one another;

the at least one acoustic scatterer includes a plurality of acoustic scatterers separate from each other by a distance; and wherein the incidence angle of the sound waves absorbed by the acoustic structure varies based on a distance between a plurality of acoustic scatterers; and the incidence angle of the sound waves absorbed by the acoustic structure increases as the distance between the plurality of acoustic scatterers decreases.

13. The acoustic structure of claim 1, wherein the acoustic structure is made of a rigid material.

14. An acoustic scatterer having a resonant frequency, the acoustic scatterer comprising:

a housing defining an opening;

a first channel, wherein the first channel has a first channel open end and a first channel terminal end that forms a first chamber, the first channel open end being in fluid communication with the opening;

a second channel, wherein the second channel has a second channel open end and a second channel terminal end that forms a second chamber, the second channel open end being in fluid communication with the opening; and wherein the first channel terminal end and the second channel terminal end are separate from one another.

15. The acoustic scatterer of claim 14, wherein the acoustic scatterer has a flat side.

16. The acoustic scatterer of claim 15, wherein the acoustic scatterer has a non-planar side, the non-planar side having the opening.

17. The acoustic scatterer of claim 16, wherein the acoustic scatterer has a half cylinder shape, the half cylinder shape defining the non-planar side and the flat side.

18. The acoustic scatterer of claim 14, wherein at least one of the first channel and the second channel are shaped in a zigzag design.

19. The acoustic scatterer of claim 14, wherein a volume of the first channel is substantially equal to a volume of the second channel.

20. The acoustic scatterer of claim 14, wherein a shape of the first channel across a width of the acoustic scatterer is a mirror image of a shape of the second channel across the width of the acoustic scatterer.

* * * * *